US011721263B2

(12) United States Patent
Chen et al.

(10) Patent No.: US 11,721,263 B2
(45) Date of Patent: Aug. 8, 2023

(54) E-PAPER DISPLAY APPARATUS AND E-PAPER DISPLAY PANEL

(71) Applicant: E Ink Holdings Inc., Hsinchu (TW)

(72) Inventors: Wei-Tsung Chen, Hsinchu (TW); Xue-Hung Tsai, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 17/953,330

(22) Filed: Sep. 27, 2022

(65) Prior Publication Data

US 2023/0206802 A1 Jun. 29, 2023

(30) Foreign Application Priority Data

Dec. 24, 2021 (TW) ..... 110148687

(51) Int. Cl.
*G09G 3/20* (2006.01)

(52) U.S. Cl.
CPC ..... *G09G 3/20* (2013.01); *G09G 2300/0842* (2013.01); *G09G 2340/0435* (2013.01); *G09G 2380/14* (2013.01)

(58) Field of Classification Search
CPC ... G09G 2300/0842; G09G 2340/0435; G09G 2380/14; G09G 3/20
See application file for complete search history.

(56) References Cited

U.S. PATENT DOCUMENTS

2003/0034950 A1 2/2003 Liang et al.
2015/0381798 A1* 12/2015 Yoon ..... H04W 4/80 455/411
2017/0236497 A1* 8/2017 Huitema ..... G04G 21/08 345/173
2019/0354212 A1* 11/2019 Cheng ..... G06F 3/0446
2022/0398984 A1* 12/2022 Koide ..... G09G 3/344

FOREIGN PATENT DOCUMENTS

TW 201207540 2/2012
TW 201825996 7/2018

* cited by examiner

*Primary Examiner* — Gerald Johnson
(74) *Attorney, Agent, or Firm* — JCIPRNET

(57) ABSTRACT

An e-paper display apparatus including an e-paper display panel is provided. The e-paper display panel includes a plurality of pixel circuits arranged in an array. Each of the pixel circuits includes a transistor device, a storage capacitor and a pixel capacitor. A data voltage is configured to drive the storage capacitor and the pixel capacitor, so as to drive the e-paper display panel to display image. The transistor device is an oxide thin-film transistor. An absolute value of the data voltage is greater than or equal to 20 voltages.

3 Claims, 6 Drawing Sheets

E-PAPER DISPLAY APPARATUS AND E-PAPER DISPLAY PANEL

CROSS-REFERENCE TO RELATED APPLICATION

This application claims the priority benefit of Taiwan application serial no. 110148687, filed on Dec. 24, 2021. The entirety of the above-mentioned patent application is hereby incorporated by reference herein and made a part of this specification.

BACKGROUND

Technical Field

The disclosure relates to a display apparatus and a display panel thereof, and in particular, to an e-paper display apparatus and an e-paper display panel thereof.

Description of Related Art

E-paper is driven by driving electrophoresis ink with an electric field to display different grayscales or colors. The movement of the electrophoresis ink is controlled by a driving voltage and a driving time. A moving speed of the electrophoresis ink may affect a page update time. In the conventional technology, a low page flipping speed due to a long page update time causes flashing lights and eye discomfort when human eyes look at an e-paper display panel.

Therefore, it is necessary to design an e-paper display apparatus exhibiting a high page flipping speed and providing favorable display quality.

SUMMARY

Accordingly, the disclosure is directed to an e-paper display panel with a high voltage and high frequency driving mode and with a metal oxide transistor capable of supporting a high voltage and high frequency to increase a frame rate of the panel and reduce a page update time. That is, a high-frequency transistor backplane is adopted to increase a moving speed of electrophoresis ink at the same time to display a correct grayscale or color.

The disclosure provides an e-paper display apparatus and an e-paper display panel thereof. The e-paper display apparatus exhibits a high page flipping speed and may provide favorable display quality.

The e-paper display apparatus of the disclosure includes an e-paper display panel. The e-paper display panel includes multiple pixel circuits arranged in an array. Each of the pixel circuits includes a transistor device, a storage capacitor, and a pixel capacitor. A data voltage drives the storage capacitor and the pixel capacitor through the transistor device so that the e-paper display panel displays an image. The transistor device is an oxide thin-film transistor. An absolute value of the data voltage is greater than or equal to 20 volts.

An e-paper display panel of the disclosure includes multiple pixel circuits arranged in an array. Each of the pixel circuits includes a transistor device, a storage capacitor, and a pixel capacitor. A data voltage drives the storage capacitor and the pixel capacitor through the transistor device so that the e-paper display panel displays an image. The transistor device is an oxide thin-film transistor. An absolute value of the data voltage is greater than or equal to 20 volts.

In an embodiment of the disclosure, the absolute value of the data voltage is equal to 28 volts.

In an embodiment of the disclosure, a frame rate of the e-paper display panel is greater than or equal to 120 Hz.

In an embodiment of the disclosure, the frame rate of the e-paper display panel is 120 Hz, 200 Hz, or 240 Hz.

In an embodiment of the disclosure, a material of a channel layer of the oxide thin-film transistor is indium gallium zinc oxide or indium zinc tin oxide.

An e-paper display panel of the disclosure includes multiple pixel circuits arranged in an array. Each of the pixel circuits includes a transistor device, a storage capacitor, and a pixel capacitor. A data voltage drives the storage capacitor and the pixel capacitor through the transistor device so that the e-paper display panel displays an image. The transistor device is an oxide thin-film transistor. A frame rate of the e-paper display panel is greater than or equal to 120 Hz.

In an embodiment of the disclosure, an absolute value of the data voltage is greater than or equal to 20 volts.

In order to make the aforementioned features and advantages of the disclosure comprehensible, embodiments accompanied with drawings are described in detail below.

DESCRIPTION OF THE EMBODIMENTS

Figure 1:
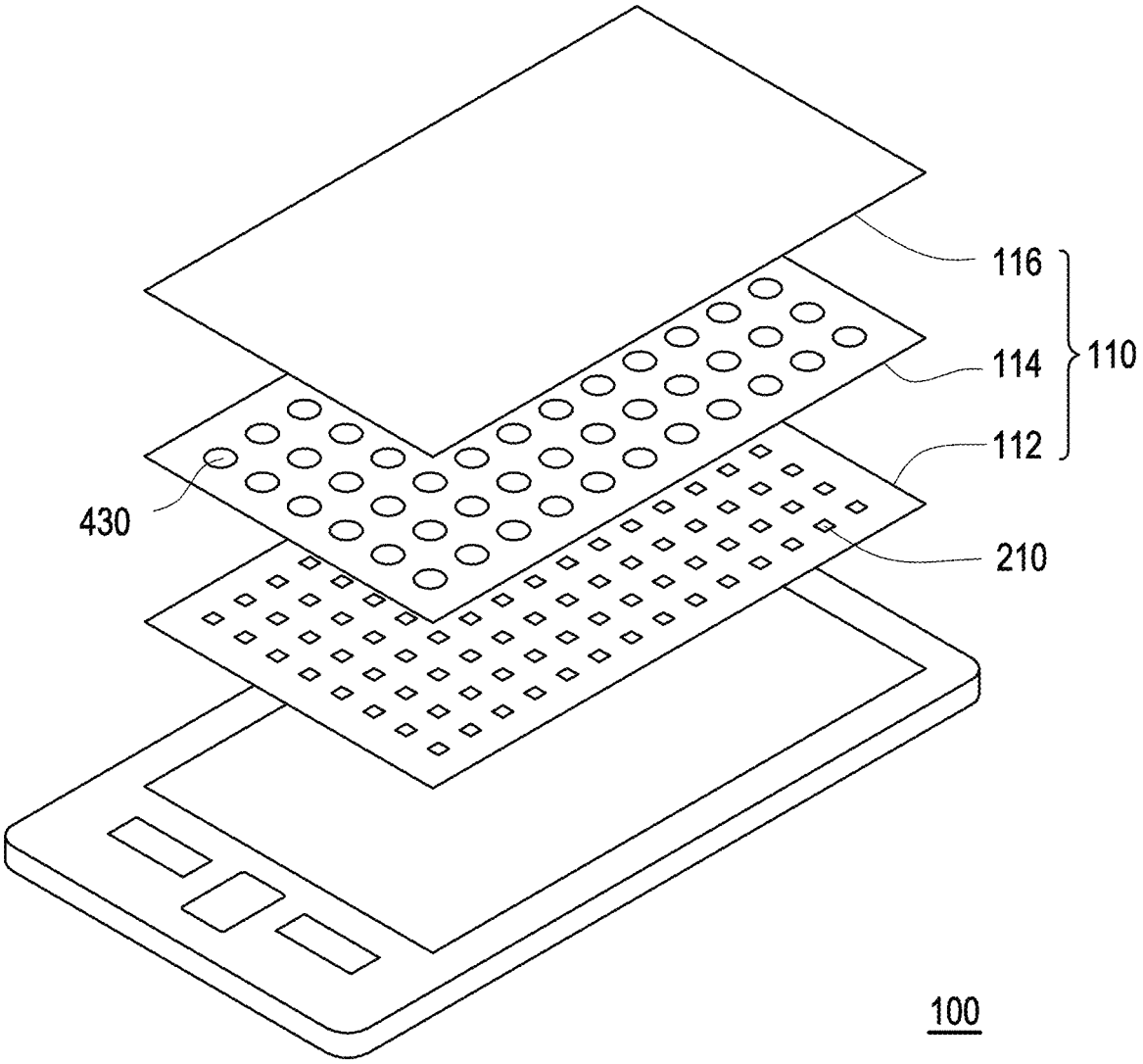
FIG. 1 is a schematic diagram of an e-paper display apparatus according to an embodiment of the disclosure.
Figure 2:
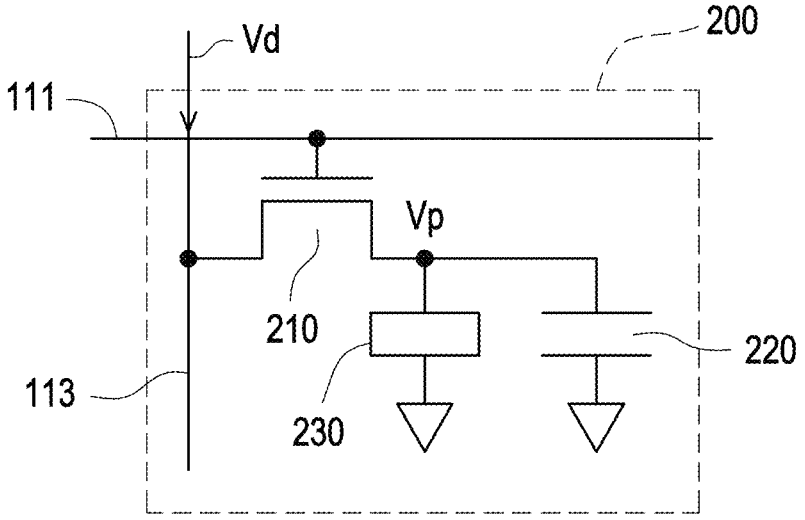
FIG. 2 is a schematic diagram of a pixel circuit of the e-paper display apparatus of FIG. 1.

FIG. 1 is a schematic diagram of an e-paper display apparatus according to an embodiment of the disclosure. FIG. 2 is a schematic diagram of a pixel circuit of the e-paper display apparatus of FIG. 1. Referring to FIG. 1, an e-paper display apparatus 100 includes an e-paper display panel 110. The e-paper display panel 110 includes layer structures such as a circuit layer 112, an electrophoresis layer 114, and a protection layer 116. The e-paper display panel 110 includes multiple pixel circuits 200 arranged in an array. The pixel circuit 200 includes a transistor device 210, a storage capacitor 220, and a pixel capacitor 230. A pixel voltage of the pixel capacitor 230 is denoted by Vp. The pixel circuits 200 are located at the circuit layer 112. That is, the circuit layer 112 includes the multiple pixel circuits 200 arranged in an array.

Specifically, the circuit layer 112 is, for example, a thin film transistor backplane and includes the multiple transistor devices 210 arranged in an array. The technology of electrophoretic ink is generally known as electronic ink. The electronic ink is coated on a layer of a plastic thin film to form the electrophoresis layer 114. The electrophoresis layer 114 is attached to the circuit layer 112 to be driven by a driving chip to display an image. The protection layer 116 as a protection film is configured to protect the layer structures of the e-paper display panel 110.

Figure 3:
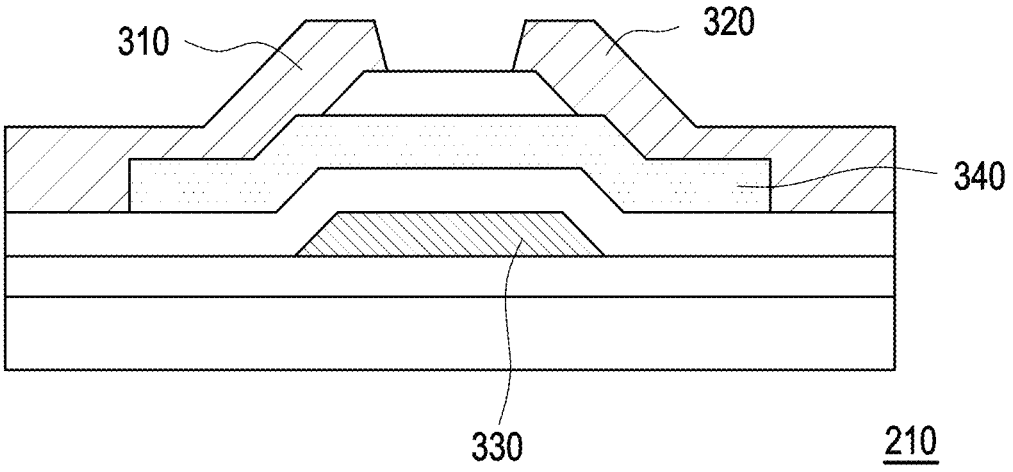
FIG. 3 is a schematic diagram of a structure of a transistor device of an embodiment of FIG. 2.

FIG. 3 is a schematic diagram of a structure of a transistor device of an embodiment of FIG. 2. Referring to FIG. 2 and FIG. 3, the transistor device 210 of FIG. 2 is implemented, for example, as an oxide thin-film transistor, and the structure therefore is as shown in FIG. 3. The transistor device 210 includes a first source/drain 310, a second source/drain 320, a gate electrode 330, and a channel layer 340. A material of the channel layer 340 is an oxide, such as indium gallium zinc oxide (IGZO) or indium zinc tin oxide (IZTO). The oxide thin-film transistor exhibits a property of very low off current. Hence, the oxide thin-film transistor may maintain a pixel voltage in a high voltage and high temperature mode. The oxide thin-film transistor structure and a material of the channel layer of FIG. 3 are only illustrative, and they are not intended to limit the disclosure.

Figure 4A:
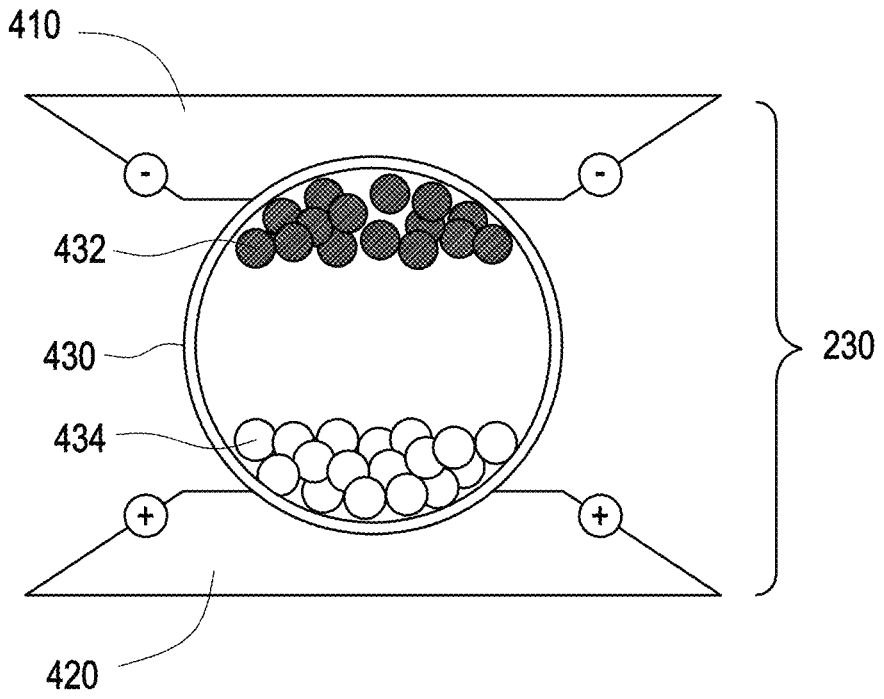
FIG. 4A and FIG. 4B are respectively schematic diagrams of microcapsules of the embodiment of FIG. 2 in an electrophoresis layer in different states.
Figure 4B:
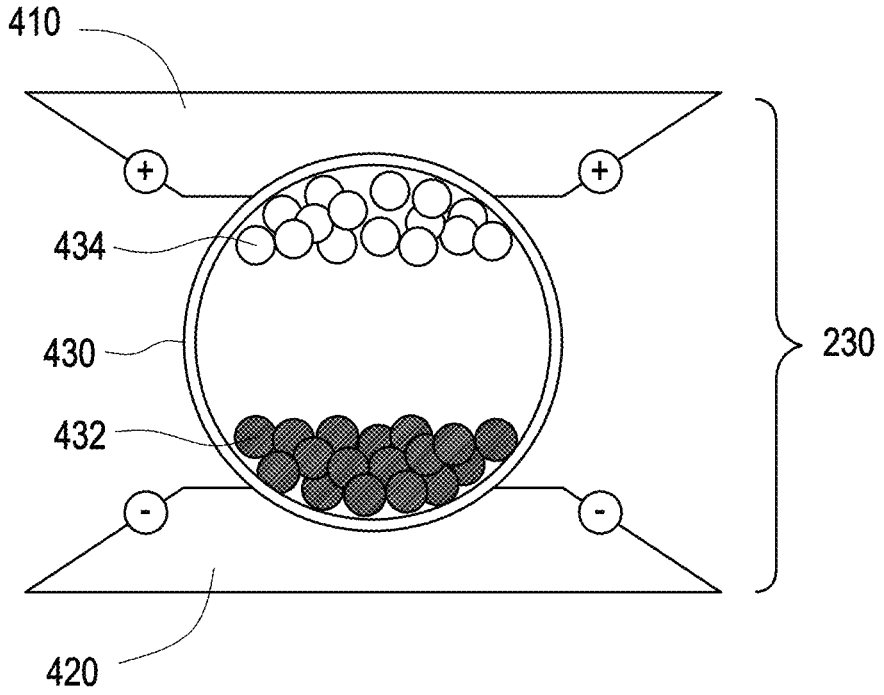

FIG. 4A and FIG. 4B are respectively schematic diagrams of microcapsules of the embodiment of FIG. 2 in an electrophoresis layer in different states. Referring to FIG. 2, FIG. 4A, and FIG. 4B, the electrophoresis layer 114 includes millions of microcapsules 430. A diameter of the microcapsules 430 is approximately equal to a diameter of human hair. Each of the microcapsules 430 includes electrophoretic particles. The electrophoretic particles are negatively charged white particles 434 and positively charged black particles 432 suspended in a transparent liquid. A size of the microcapsules 430 and a color of the electrophoretic particles are not intended to limit the disclosure. That is, the e-paper display apparatus 100 may display a dual-color (white and black), three-color (white, red, and black), four-color (white, red, yellow, black), or multi-color image.

An upper electrode 410 and a lower electrode 420 of the electrophoresis layer 114 form the pixel capacitor 230. During a driving period, a scan signal causes the transistor device 210 to be turned on through a scan line 111. Next, a data voltage Vd is written into the pixel circuits 200 through a data line 113 to drive the pixel circuits 200 to display the image. When the data voltage Vd is applied to the upper electrode 410 and the lower electrode 420, the electrophoretic particles are driven to move. In FIG. 4A, a negative voltage is applied to the upper electrode 410 and a positive voltage is applied to the lower electrode 420 to drive the positively charged black particles 432 to move toward the upper electrode 410 and drive the negatively charged white particles 434 to move toward the lower electrode 420. As a result, the pixel is presented as black. In FIG. 4B, the positive voltage is applied to the upper electrode 410 and the negative voltage is applied to the lower electrode 420 to drive the positively charged black particles 432 to move toward the lower electrode 420 and drive the negatively charged white particles 434 to move toward the upper electrode 410. As a result, the pixel is presented as white.

In the embodiment, the negative voltage is less than or equal to −20 volts, and the positive voltage is greater than or equal to +20 volts. That is, an absolute value of the data voltage Vd is greater than or equal to 20 volts. For example, the negative voltage is −28 volts, and the positive voltage is +28 volts. Or, for example, the negative voltage is −20 volts, and the positive voltage is +20 volts. Since the transistor device 210 of FIG. 2 is implemented as the oxide thin-film transistor and the oxide thin-film transistor exhibits a property of high carrier mobility, the e-paper display panel 110 may still provide favorable display quality when it is operated in a high voltage and high frequency mode.

The carrier mobility of the oxide thin-film transistor is greater than 5 $cm^2/V^{-1}\cdot s^{-1}$. The high voltage is, for example, the data voltage Vd whose absolute value is greater than or equal to 20 volts. In a high panel frequency mode, a frame rate of the e-paper display panel 110 is greater than or equal to 120 Hz. For example, the frame rate of the e-paper display panel 110 is 120 Hz, 200 Hz, or 240 Hz.

For example, in a first embodiment, the absolute value of the data voltage Vd is equal to 28 volts, and the frame rate is 200 Hz. In a second embodiment, the absolute value of the data voltage Vd is equal to 28 volts, and the frame rate is 240 Hz. In a third embodiment, the absolute value of the data voltage Vd is equal to 20 volts, and the frame rate is 120 Hz. In the three embodiments above, the e-paper display panel 110 may provide the favorable display quality when it is operated in the high voltage and high frequency mode.

Figure 5A:
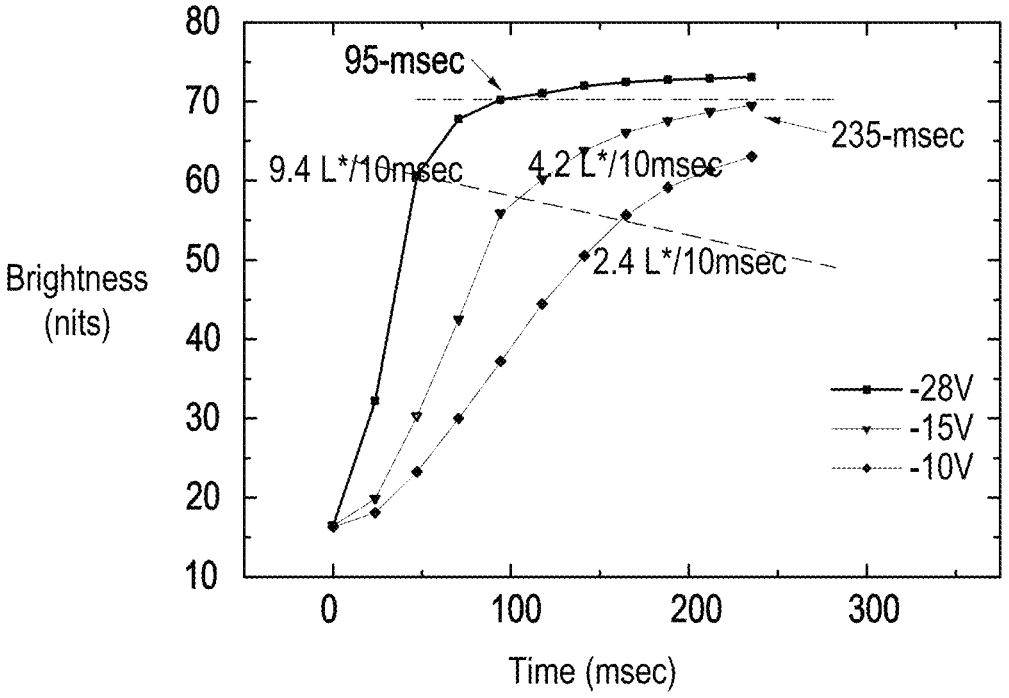
FIG. 5A and FIG. 5B are curve charts of a page change time of an e-paper display panel driven by different data voltages.
Figure 5B:
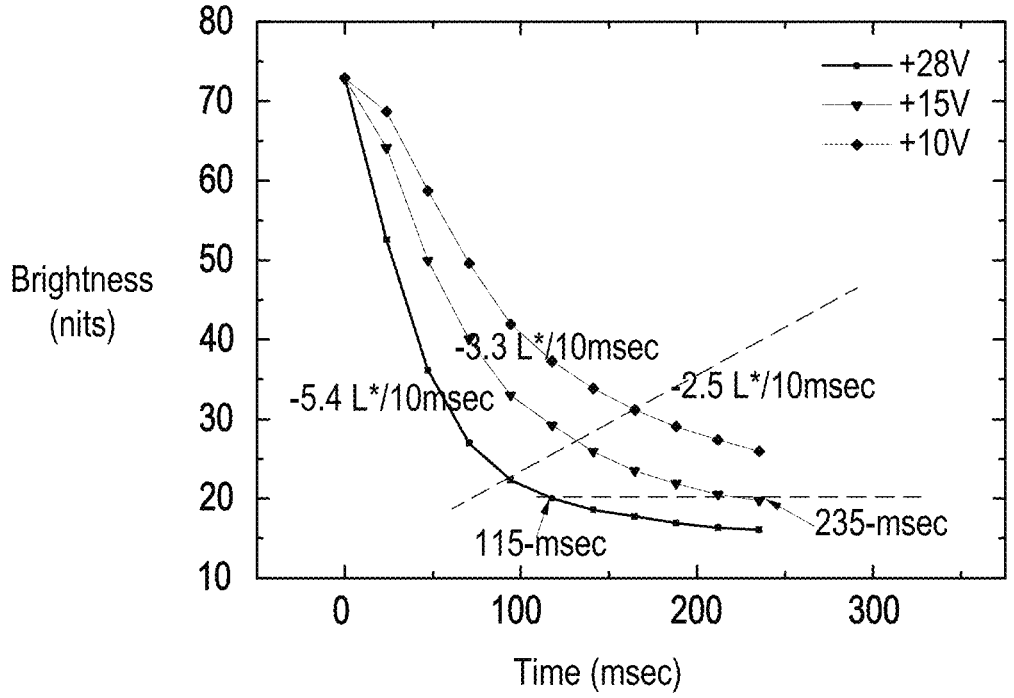

FIG. 5A and FIG. 5B are curve charts of page update time of an e-paper display panel driven by different data voltages. Referring to FIG. 5A and FIG. 5B, when the e-paper display panel 110 is operated in the high voltage mode, for example, in which the absolute value of the data voltage Vd is equal to 28 volts, it takes 95 ms (as shown in FIG. 5A) (page change time) to switch a black page into a white page, and it tales 115 ms (as shown in FIG. 5B) (page change time) to switch the white page into the black page. Compared with an e-paper display panel driven by a low voltage (e.g. plus and minus 15 volts), the page change time of the e-paper display panel driven by the low-voltage is 235 ms. According to the data above, in the high voltage mode, the page change time of e-paper may be reduced. In the embodiment of FIG. 2, since the transistor device 210 is implemented as the oxide thin-film transistor, the electrophoretic particles may be driven by the high voltage. Furthermore, the e-paper display panel 110 is operated in the high frequency mode, thereby effectively reducing the page change time of the e-paper display apparatus 100.

Figure 6:
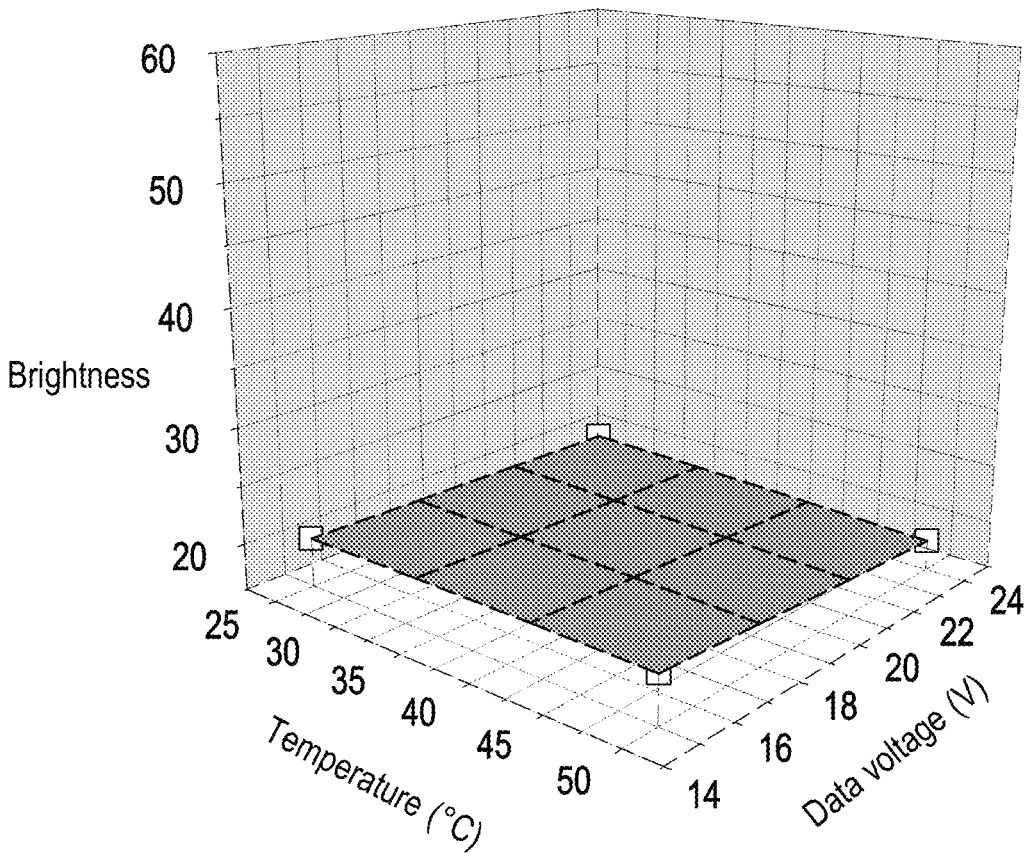
FIG. 6 is a histogram of brightness of black areas surrounded by white areas of an e-paper display panel at different temperatures and data voltages.

FIG. 6 is a histogram of brightness of black areas surrounded by white areas of an e-paper display panel at different temperatures and data voltages. Referring to FIG. 6, when the e-paper display panel 110 is operated in the high voltage mode, for example, in which the absolute value of the data voltage Vd is greater than or equal to 20 volts, and the e-paper display panel 110 adopting the oxide thin-film transistor backplane displays black areas surrounded by white areas at a room temperature or a high temperature, a brightness L* (L* is a brightness of a chromaticity coordinate L*a*b*) of the black areas may be less than 20 without being affected by the other white areas. For example, when the e-paper display panel 110 displays the black areas surrounded by the white areas at a room temperature of 25° C., the brightness of the e-paper display panel 110 is 19.53. When the e-paper display panel 110 displays the black areas surrounded by the white areas at a high temperature of 50° C., the brightness of the e-paper display panel 110 is 18.57. Therefore, in the high voltage mode, when the e-paper display panel 110 is operated in a predetermined temperature range (e.g. 25° C. to 50° C.) to display the black areas surrounded by the white areas, the brightness L* may be less than 20 to maintain the favorable display quality.

Figure 7:
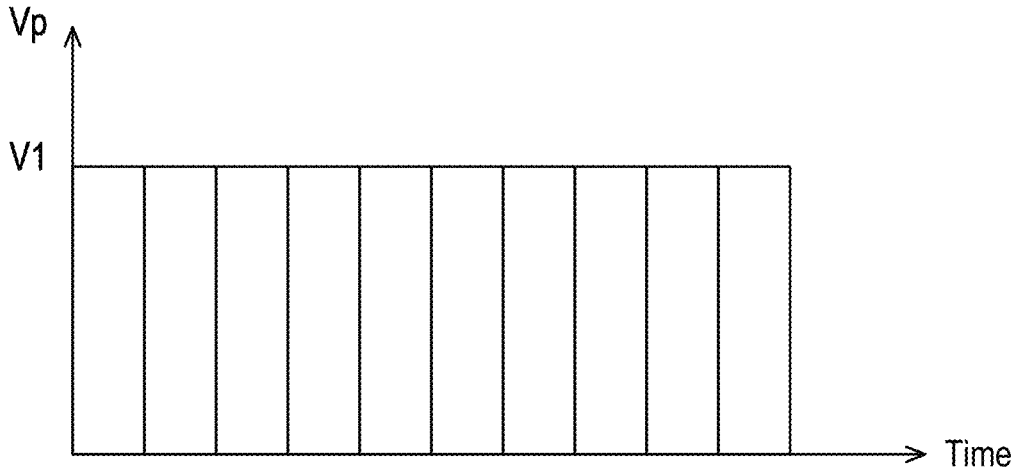
FIG. 7 is a schematic diagram illustrating waveforms of a pixel circuit according to an embodiment of the disclosure.

FIG. 7 is a schematic diagram illustrating waveforms of a pixel circuit according to an embodiment of the disclosure. Referring to FIG. 1, FIG. 2, and FIG. 7, the e-paper display panel 110 shown in FIG. 7 is operated in the high panel frequency mode. In the high panel frequency mode, a set of signal waveforms for driving the pixel circuits 200 to display the images as shown in FIG. 7 includes 10 frames. During the driving period, when the transistor device 210 is turned on, the data voltage is written into the pixel circuits 200 through the data line 113 and an electric field formed by the voltage drives the pixel circuits 200 to display the image in a time period of a frame. Since the transistor device 210 is implemented as the oxide thin-film transistor, the transistor device 210 exhibits a property of very low off current. When the transistor device 210 is not turned on, the pixel voltage Vp of the pixel capacitor 230 may maintain the voltage waveforms as shown in FIG. 7 in a time period of the entire frame without being affected by a change in the voltage of the data line, even being driven by the high voltage. For example, the voltage waveforms are maintained at a voltage value V1.

In summary of the above, in the embodiments of the disclosure, since the transistor device is the oxide thin-film transistor, when the e-paper display panel is operated at the high frame rate, the page update time may be reduced and the favorable the display quality may be maintained at the same time. In addition, in the embodiments of the disclosure, since the transistor device is the oxide thin-film transistor, the e-paper display panel may be driven in a high-voltage manner to increase a page flipping speed. According to the above, in the disclosure, the e-paper display panel may be driven in a high-voltage and high-frequency manner to increase the page flipping speed. The page update time may be reduced, and the favorable the display quality may be maintained at the same time.

Although the disclosure has been described with reference to the above embodiments, they are not intended to limit the disclosure. It will be apparent to one of ordinary skill in the art that modifications to the described embodiments may be made without departing from the spirit and the scope of the disclosure. Accordingly, the scope of the disclosure will be defined by the attached claims and their equivalents and not by the above detailed descriptions.

What is claimed is:

1. An e-paper display apparatus, comprising:

an e-paper display panel comprising a plurality of pixel circuits arranged in an array, wherein each of the pixel circuits comprises a transistor device, a storage capacitor, and a pixel capacitor, and a data voltage drives the storage capacitor and the pixel capacitor through the transistor device so that the e-paper display panel displays an image, wherein the transistor device is an oxide thin-film transistor, and an absolute value of the data voltage is greater than or equal to 20 volts, wherein the absolute value of the data voltage is equal to 28 volts, wherein a frame rate of the e-paper display panel is greater than or equal to 120 Hz, wherein a material of a channel layer of the oxide thin-film transistor is indium gallium zinc oxide or indium zinc tin oxide.

2. The e-paper display apparatus according to claim 1, wherein the frame rate of the e-paper display panel is 120 Hz, 200 Hz, or 240 Hz.

3. An e-paper display panel comprising a plurality of pixel circuits arranged in an array, wherein each of the pixel circuits comprises a transistor device, a storage capacitor, and a pixel capacitor, and a data voltage drives the storage capacitor and the pixel capacitor through the transistor device so that the e-paper display panel displays an image, wherein the transistor device is an oxide thin-film transistor, wherein an absolute value of the data voltage is equal to 28 volts, wherein a frame rate of the e-paper display panel is greater than or equal to 120 Hz, wherein a material of a channel layer of the oxide thin-film transistor is indium gallium zinc oxide or indium zinc tin oxide.

* * * * *